US007258926B2

(12) United States Patent
Shinozaki

(10) Patent No.: US 7,258,926 B2
(45) Date of Patent: Aug. 21, 2007

(54) SOLID LUBRICANT AND SLIDING MEMBERS

(75) Inventor: Masanori Shinozaki, Chofu (JP)

(73) Assignee: Juki Corporation, Tokyo (JP)

( * ) Notice: Subject to any disclaimer, the term of this patent is extended or adjusted under 35 U.S.C. 154(b) by 0 days.

(21) Appl. No.: 10/688,618

(22) Filed: Oct. 17, 2003

(65) Prior Publication Data

US 2004/0204540 A1 Oct. 14, 2004

(30) Foreign Application Priority Data

Oct. 17, 2002 (JP) ..... 2002-303183

(51) Int. Cl.
*B23B 25/20* (2006.01)

(52) U.S. Cl. ..... 428/447; 524/588; 524/424

(58) Field of Classification Search ..... 524/588, 524/424

See application file for complete search history.

(56) References Cited

U.S. PATENT DOCUMENTS 5,916,499 A 6/1999 Murayama et al.
2002/0114548 A1* 8/2002 Hokkirigawa et al. ..... 384/297
2003/0134104 A1 7/2003 Hokkirigawa et al.

FOREIGN PATENT DOCUMENTS

| | | | |
|---|---|---|---|
| EP | 0 469 906 | | 2/1992 |
| EP | 1 344 791 | | 9/2003 |
| JP | 63-5640 (B2) | | 2/1988 |
| JP | 7-167206 | | 7/1995 |
| JP | 8-18345 | | 1/1996 |
| JP | 2577416 (B2) | | 11/1996 |
| JP | 10-101453 (A) | | 6/1999 |
| JP | 3060389 | | 6/1999 |
| JP | 11-207757 | | 8/1999 |
| JP | 2002-30222 | | 1/2002 |
| JP | 2002-235016 | * | 8/2002 |

* cited by examiner

*Primary Examiner*—Kuo-Liang Peng
(74) *Attorney, Agent, or Firm*—Merchant & Gould P.C.

(57) ABSTRACT

A suspension having a powder of RBC (rice bran ceramics) suspended in a liquid resin is used as a solid lubricant. The solid lubricant preferably has an RBC proportion of 22 to 74% by weight. The RBC preferably has a mean particle diameter not exceeding 5 μm. An acrylsilicone resin is preferably used as the liquid resin used as the binder. The solid lubricant is applied onto the sliding surface of a sliding member made of a metal, any of various resins, etc. to form a dry film thereon.

13 Claims, 4 Drawing Sheets

SOLID LUBRICANT AND SLIDING MEMBERS

BACKGROUND OF THE INVENTION

1. Field of the Invention

This invention relates to a solid lubricant and a sliding member having a sliding surface covered with a dry film formed by applying a solid lubricant.

2. Description of the Related Art

In the related arts of this invention, there has been developed a solid lubricant which is prepared by using molybdenum disulfide ($MoS_2$), a polytetrafluoroethylene resin (PTFE), etc. as a filler and a polyimide, polyamide-imide or epoxy resin, etc. as a binder, as disclosed, for example, in the Japanese patent publications such as shown in JP-B-63-5640 or JP 2,577,416.

Also developed is a hard porous carbonaceous material made by burning and carbonizing in a nitrogen gas atmosphere a material prepared by mixing defatted rice bran with a phenol resin, and called RBC (rice bran ceramics), as disclosed in the raid open patent publication JP-A-10-101453.

The solid lubricant is, however, primarily aimed at a reduction of friction and an improved scoring resistance in the initial stage. Even if it may give good initial sliding properties, the wear of the solid lubricant occurring with the passage of time causes the base surface to be exposed and eventually undergo scoring (roughening of the sliding surface) or seizure.

The performance (wear resistance, coefficient of friction, etc.) of the solid lubricant differs markedly with the properties of the constituents of the filler and binder particularly in an oil-free environment. Consideration is, therefore, required for the selection of the constituents of the filler and binder in order to improve the performance of the solid lubricant.

SUMMARY OF THE INVENTION

It is an object of this invention to employ RBC as a filler for a solid lubricant and provide a solid lubricant giving good wear resistance and sliding properties.

For solving the above problems, the solid lubricant in this invention is characterized by comprising a suspension having a powder of RBC (rice bran ceramics) suspended in a liquid resin, the suspension being capable of forming a dry film upon coating and drying.

The invention according to the first aspect of this invention enables the solid lubricant to form upon drying a dry film having better wear resistance and sliding properties than any known solid lubricant containing molybdenum disulfide ($MoS_2$), a polytetrafluoroethylene resin (PTFE), etc. as a filler.

The presence of RBC as a kind of carbonaceous material makes it possible to form a dry film having electrical conductivity. Moreover, significant effect can be also expected in use of mold-release compound.

The invention according to the second aspect of this invention is characterized in that the RBC in the solid lubricant is in the proportion of from 22 to 74% by weight.

The invention provides the same advantages as the invention according to claim 1 and moreover enables the solid lubricant to form a dry film having still better wear resistance and sliding properties upon drying.

The invention according to the second aspect of this invention is characterized in that the RBC in the solid lubricant has a mean particle diameter not exceeding 5 μm.

The invention also provides the advantages as the invention according to the first and second aspects, and moreover enables the solid lubricant to form upon hardening a dry film having a surface of improved smoothness giving still better sliding properties, since the RBC has a mean particle diameter not exceeding 5 μm.

The invention according to the fourth aspect of this invention is characterized in that the liquid resin in the solid lubricant is an acrylsilicone resin.

The invention provides the same advantages as the invention according to any one of the preceding aspects of this invention, and moreover enables the solid lubricant to form a dry film giving good wear resistance and sliding properties easily upon coating and drying onto an object.

This material can form a sliding surface having good wear resistance and sliding properties only by coating onto predetermined portions without requiring any special heat treatment.

The sliding member as the invention according to the fifth aspect of this invention is characterized by having a sliding surface covered with a dry film formed by applying the solid lubricant according to any one of the preceding aspects of this invention.

The invention provides the sliding member with a sliding surface having good wear resistance and sliding properties. The sliding member having a sliding surface of good wear resistance and sliding properties is easy to make only if the solid lubricant is applied to its sliding surface. Moreover, it is possible to use a metallic material, or any of various resins including an ABS resin for the main body of the sliding member.

DESCRIPTION OF THE PREFERRED EMBODIMENTS

Description will now be made of solid lubricants and sliding members embodying this invention with reference to drawings.

Test specimens for sliding members (Test Specimens 1 to 3) were prepared by preparing three kinds of solid lubricants each comprising a suspension containing 22%, 60% or 74% by weight of RBC (a powder having a particle diameter not exceeding 5 μm) in acrylsilicone (product of Chisso Corporation designated as SCT-8102), applying each lubricant onto the sliding surface (having an area of 50 $mm^2$) of a sliding member made of an aluminum alloy to form a thickness of 10 to 100 μm and drying it at 100° C. for 0.5 hour to form a dry film.

The coated surfaces of the three test specimens were photographed through an electron microscope. The RBC particles having a diameter not exceeding 5 μm were confirmed on all of Test Specimens 1 to 3.

The hardened solid lubricant on Test Specimen 1 having an RBC proportion of 22% by weight was found to contain the RBC particles scattered in the acrylsilicone. The hardened solid lubricant surfaces on Test Specimens 2 and 3 having RBC proportions of 60 and 74%, respectively, by weight were found covered substantially uniformly with the RBC particles.

Friction tests were conducted on the three test specimens by employing a rigid pendulum type physical property testing machine, PRT3000W of A & D Co., Ltd., at an oscillating cycle of 0.75 second and a temperature varying in the range of 30° C. to 350° C. (400° C.) under oil-free conditions. The results are shown below.

Figure 1:
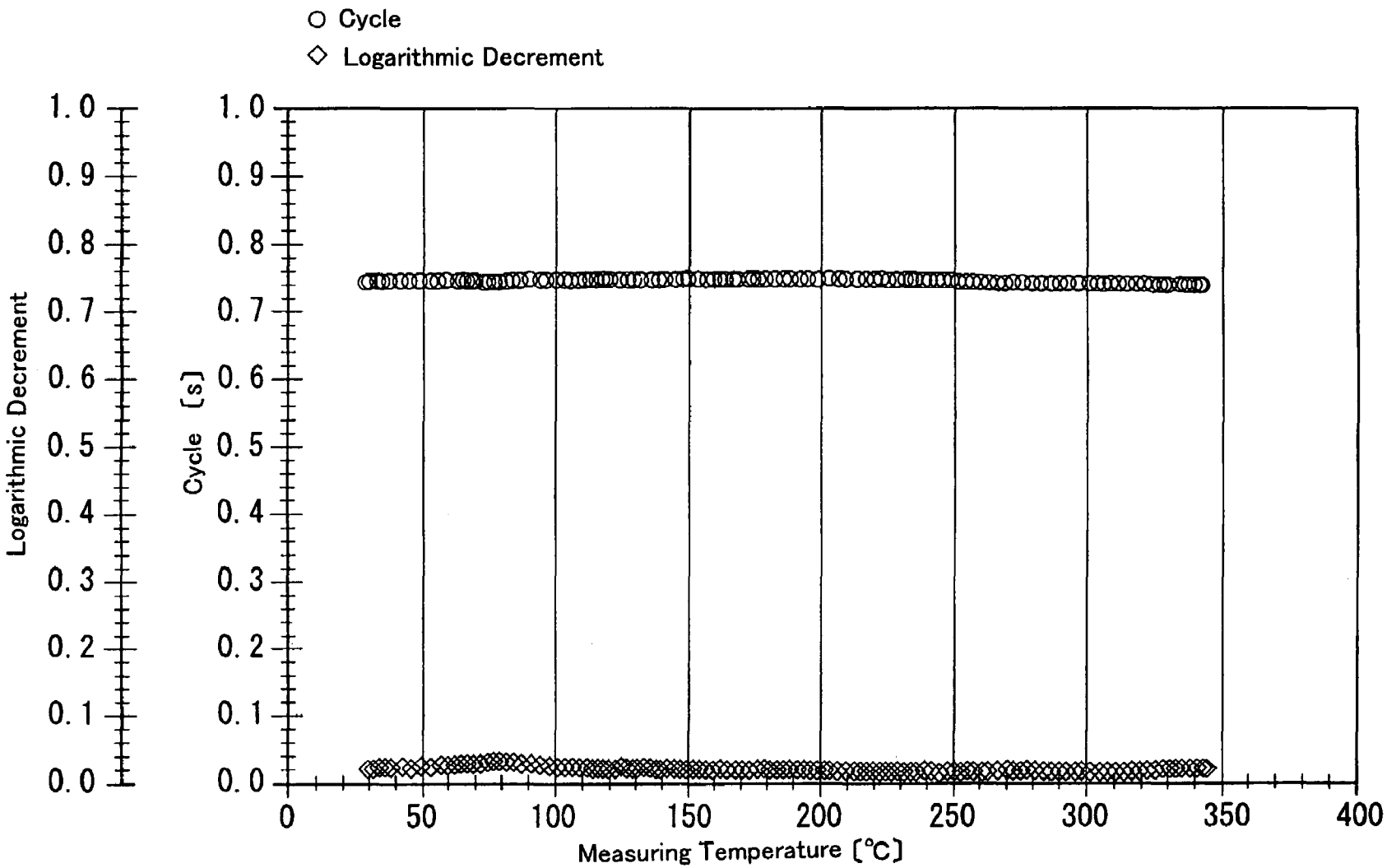
FIG. 1 is a graph showing the sliding properties of a solid lubricant and a sliding member embodying this invention.

Test Specimen 1 maintained a substantially equal logarithmic decrement of friction in the vicinity of 0.02 in the range of 30° C. to 350° C. as shown in FIG. 1, and was thus ascertained as being of good sliding properties.

Figure 2:
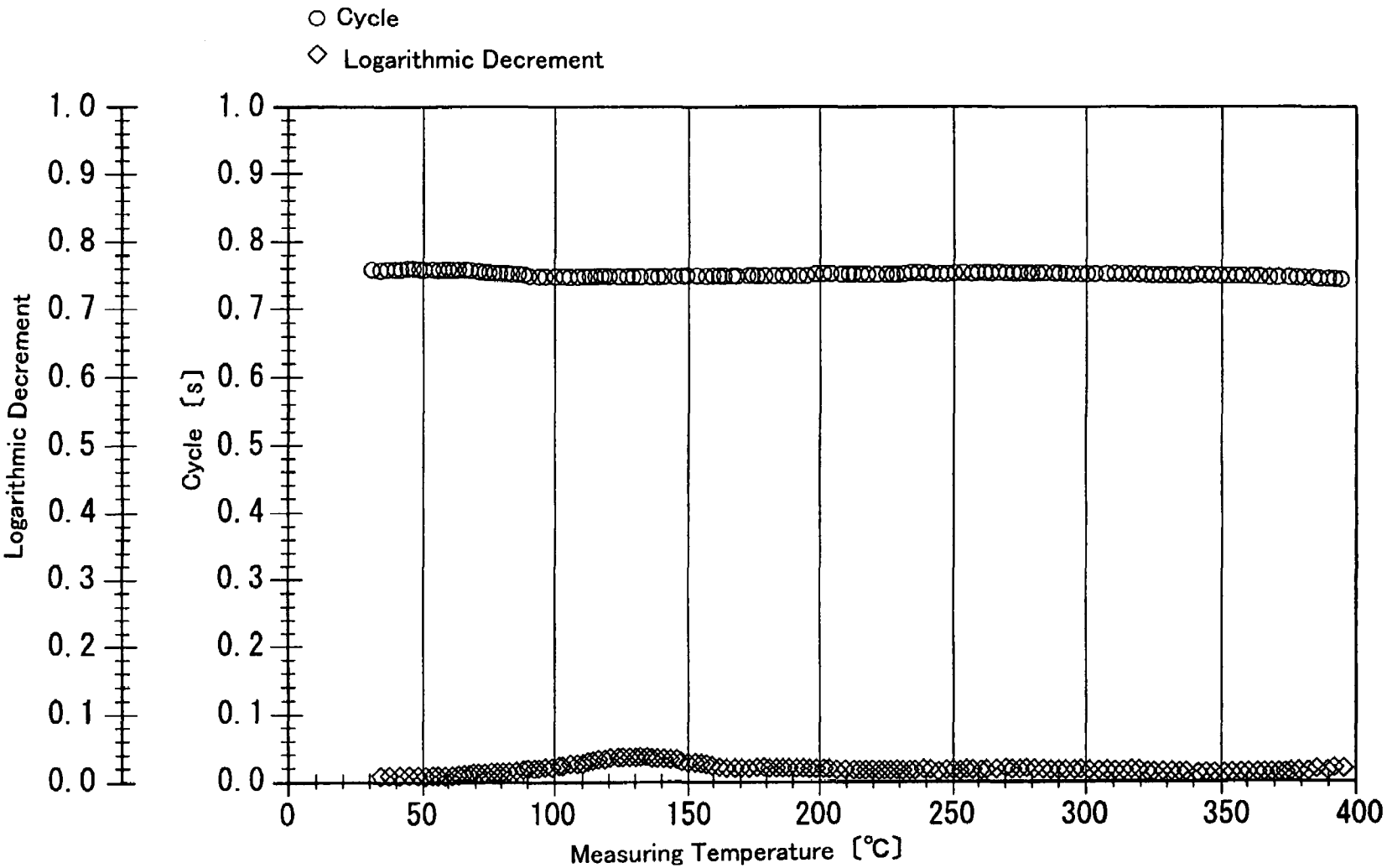
FIG. 2 is a graph showing the sliding properties of a solid lubricant and a sliding member according to another embodiment of this invention.

Test Specimen 2 tested in the range of 30° C. to 400° C. maintained a logarithmic decrement of about 0.03 in the vicinity of 100° C. to 150° C. and about 0.01 in any other temperature range as shown in FIG. 2, and was thus ascertained as being comparable to Test Specimen 1 in sliding properties.

Figure 3:
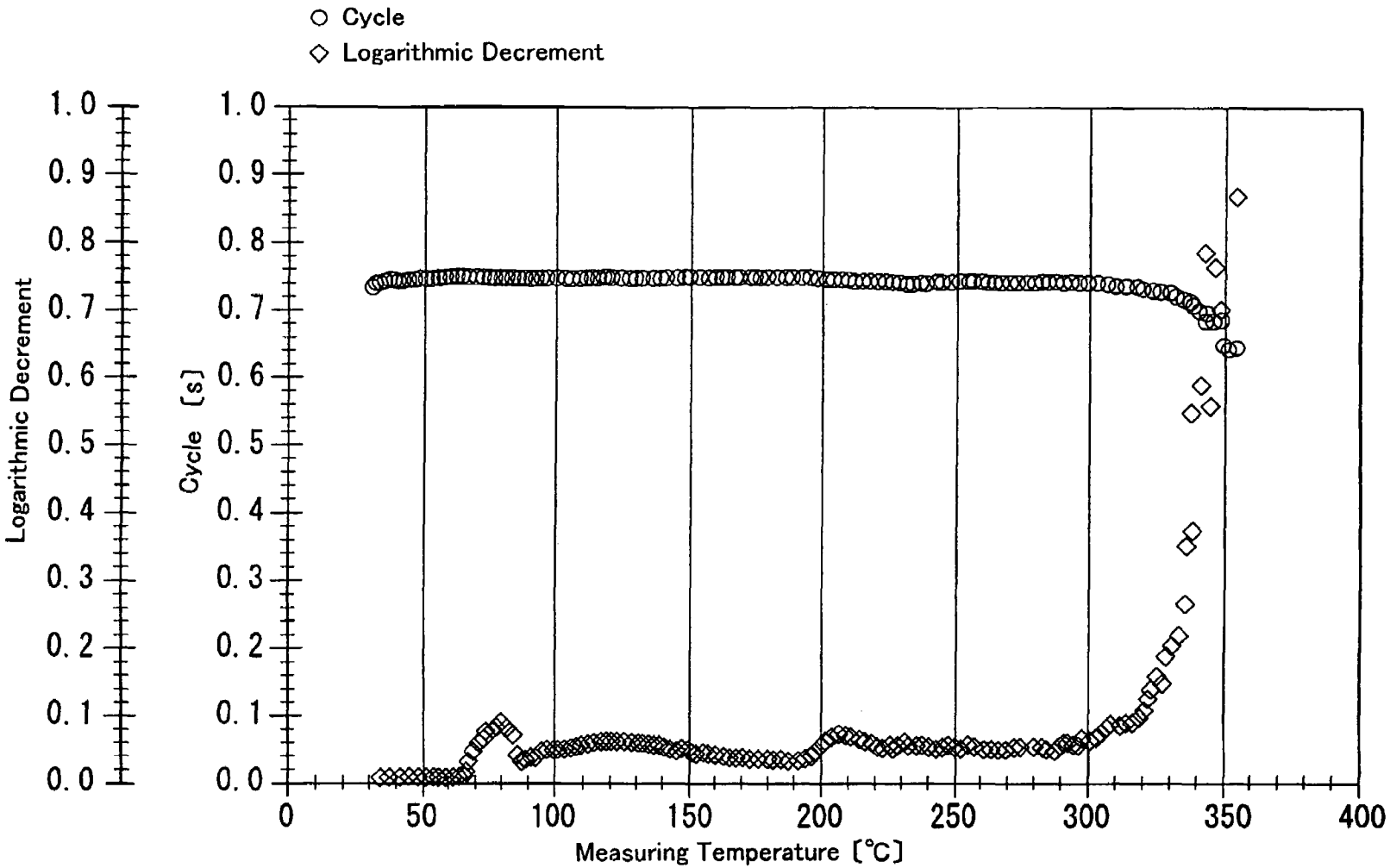
FIG. 3 is a graph showing the sliding properties of a solid lubricant and a sliding member according to still another embodiment of this invention.

Test Specimen 3 tested in the range of 30° C. to 300° C. maintained a logarithmic decrement of about 0.08 in the vicinity of 75° C. and 210° C. and about 0.01 to 0.06 in any other temperature range as shown in FIG. 3, and was found non-uniform in sliding properties as compared with Test Specimens 1 and 2.

The distribution of RBC in the surface of the dry film formed upon drying of the applied solid lubricant and the sliding properties of the sliding surface covered with the dry film as discussed above taught that the best sliding properties could be obtained when the solid lubricant had an RBC proportion of about 60% by weight.

Then, a test specimen (Test Specimen 4) was prepared by preparing a solid lubricant comprising a suspension containing 60% by weight of RBC (a powder having a particle diameter not exceeding 5 μm) in acrylsilicone (product of Chisso Corporation designated as SCT-8102), applying it onto the end surface (having an area of 50 $mm^2$) of a solid cylindrical pin made of an aluminum alloy to form a thickness of 10 to 100 μm and drying it at 100° C. for 0.5 hour to form a dry film.

For the sake of comparison, a test specimen (Test Specimen 5) was prepared by applying to the end surface of a pin as described above a commercial solid lubricant comprising a polyamideimide with molybdenum disulfide ($MoS_2$) and a polytetrafluoroethylene resin (PTFE).

A frictional wear test was conducted on those two test specimens by employing a pin-on-disk type frictional wear testing machine at a surface pressure of 0.8 MPa and a velocity of 0.314 m/s (with a rotating radius of 20 mm and a rotating speed of 150 rpm) against a carburized SCM415 material under oil-free conditions. The results are shown below.

Test Specimen 4 showed a steady friction in the range of 11 to 15 N throughout a test time of 3216 minutes and was ascertained as being free from any scoring. Test Specimen 5 showed a friction varying in the range of 12 to 15 N during the beginning of the test, but the test was discontinued as scoring was found on the dry film 198 minutes after it had been started.

Thus, it was confirmed that Test Specimen 4 having the dry film formed from the solid lubricant according to this invention had a wear resistance more than 16 times higher than Test Specimen 5 having the dry film formed from the known solid lubricant.

Figure 4A:
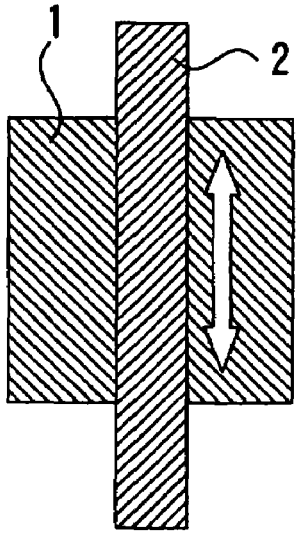
FIGS. 4(*a*) to 4(*c*) show the specific examples of application of this invention and includes (a) a sectional view showing an example of arrangement in which a shaft is supported by a bearing axially slidably, (b) a sectional view showing an example of arrangement in which a shaft is supported by a bearing slidably in the direction of rotation, and (c) a sectional view showing an example of arrangement in which a film is formed on the sliding surface of a shaft by applying and drying the solid lubricant according to this invention.
Figure 4B:
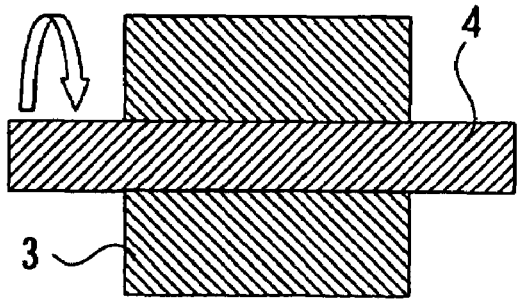
Figure 4C:
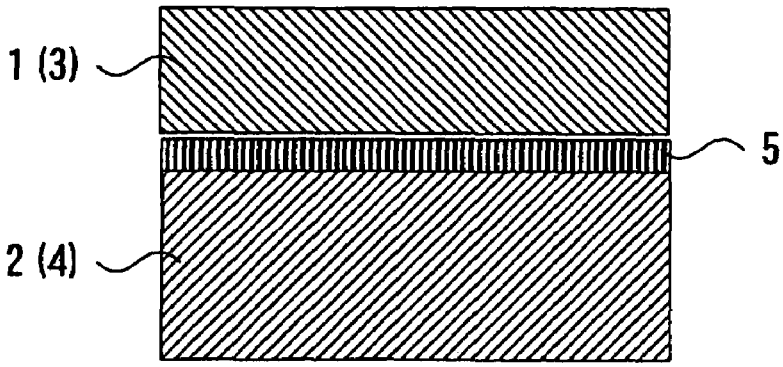

The forms of embodiment have been described by referring to sliding members as test specimens and more specifically, the uses as described below will be possible. A shaft 2 (sliding member) is supported by a bearing 1 axially slidably, as shown in FIG. 4(*a*), or a shaft 4 (sliding member) is supported by a bearing 3 slidably in the direction of its rotation, as shown in FIG. 4(*b*), and the shaft 2 or 4 has on its surface making sliding contact with the bearing 1 or 3 a sliding surface covered with a dry film 5 formed by applying and drying a solid lubricant containing a powder of RBC. Alternatively, the solid lubricant may be applied onto the surface of the bearing 1 or 3.

The solid lubricant and sliding member according to this invention are not limited to the forms of its embodiment as described above, but various improvements and design changes may be made without departing from the concept of this invention. According to the forms of embodiment described above, for example, SCT-8102 of Chisso Corporation has been employed as the binder, but it is also possible to use any other acrylsilicone resin, such as ZEMLAC (registered trademark) of Kanegafuchi Chemical Industrial Co., Ltd., after taking use and cost of production into account. Moreover, it is also possible to use a resin other than any acrylsilicone resin, for example, a polyimide, polyamideimide or epoxy resin, as the binder. It is also possible to add a curing agent if required for achieving improved mechanical properties and a reduction of friction.

The solid lubricant of this invention can be treated like a paint, and can, therefore, be used for various purposes in addition to coating the surface of a sliding member for improving its wear resistance and sliding properties. For example, it may be used to coat a die, tool or material to be worked in cold plastic working, such as known for a wire drawing, a steel rod (or a pipe) drawing, a pipe (or sheet metal) stamping, pipe (or sheet metal) rolling, an enriched ring, a header, and so on, the inner surface of a mold as a release agent in molding, or a tool or material to be worked in cutting.

Moreover, the solid lubricant of this invention can be used for the mold-release compound to release a rubber material from the mold in case of forming the rubber-molded products. It is also alternatively used for the mold-release compound in case of the cement/concrete-molded products.

Further, by coating the solid lubricant of this invention onto a paper sheet, an alternative-use product of a resin material can be made possible, which is more light weight, and a recycle using can be applied to.

Still further, in case of coating the solid lubricant of this invention onto a paper pipe, it is used for a wire-coating material having a well water-repellent or whether-durability properties, which can be made at low cost.

Although the forms of embodiment have been described as forming a dry film by drying at 100° C. for 0.5 hour, the drying temperature and time are widely variable in view of productivity, production equipment, etc. A high temperature and a short drying time may be employed if quick drying is desired, and if no temperature elevating equipment is available, drying may be allowed to last for several days at an ordinary room temperature.

It is, of course, possible to alter other specific structural details, too, as they are considered adequate.

As described above, this invention enables the solid lubricant to form upon drying a dry film having better wear resistance and sliding properties than any known solid lubricant containing molybdenum disulfide ($MoS_2$), a polytetrafluoroethylene resin (PTFE), etc. as a filler.

The presence of RBC as a kind of carbonaceous material makes it possible to form a dry film having electrical conductivity.

Moreover, this invention enables the solid lubricant to form a dry film having still better wear resistance and sliding properties upon drying.

Further, this invention enables the solid lubricant to form upon hardening a dry film having a surface of improved smoothness giving still better sliding properties, since the RBC has a mean particle diameter not exceeding 5 μm.

Still further, this invention enables the solid lubricant to form a dry film giving good wear resistance and sliding properties easily upon coating and drying on an object.

This material can form a sliding surface having good wear resistance and sliding properties without requiring any special heat treatment only but coating onto any portion as required.

The invention according provides the sliding member with a sliding surface having good wear resistance and sliding properties. The sliding member having a sliding surface of good wear resistance and sliding properties is easy to make only if the solid lubricant is applied to its sliding surface. Moreover, it is possible to use a metallic material, or any of various resins including an ABS resin for the main body of the sliding member.

What is claimed is:

1. A lubricant comprising a liquid resin and a powder of RBC (rice bran ceramics) suspended in the liquid resin, wherein the liquid resin is an acrylsilicone resin.

2. The lubricant according to claim 1, wherein the RBC is in a proportion with a range from 22 to 74% by weight.

3. The lubricant according to claim 1, wherein the RBC has a mean particle diameter not exceeding 5 μm.

4. A sliding member having a sliding surface covered with a dry film formed by applying a lubricant on the sliding surface, wherein said lubricant is comprised of a liquid resin being capable of coating and drying and a powder of RBC (rice bran ceramics) suspended in the liquid resin.

5. The sliding member according to claim 4, wherein the RBC is in a proportion with a range from 22 to 74% by weight.

6. The sliding member according to claim 4, wherein the RBC has a mean particle diameter not exceeding 5 μm.

7. The sliding member according to claim 4, wherein the liquid resin is an acrylsilicone resin.

8. The sliding member according to claim 4, wherein thickness of the dry film is 10 μm or more and 100 μm or less.

9. The sliding member according to claim 4, wherein the sliding surface is coated with the suspension and dried to form the dry film as treating like paint.

10. A lubricating film formed from a liquid resin and a powder of RBC suspended in the liquid resin wherein thickness of the film after drying is 10 μm or more and 100 μm or less and the liquid resin is an acrylsilicone resin.

11. The lubricating film according to claim 10, wherein the suspension is coated and dried to form the dry film as treating like paint.

12. A manufacturing method for preparing a sliding member having a sliding surface, comprising the steps of: suspending RBC (rice bran ceramics) in a liquid resin; coating the liquid resin having the RBC on the sliding surface like paint; and drying the liquid resin having the RBC.

13. The manufacturing method according to claim 12, wherein the coating of liquid resin having the RBC on a sliding member forms a solid lubricant.

* * * * *